US012179898B2

(12) United States Patent
Norton

(10) Patent No.: US 12,179,898 B2
(45) Date of Patent: Dec. 31, 2024

(54) OUTBOARD MOTOR STEERING AND CONTROL SYSTEM AND METHODS FOR REMOVABLE LOWER DRIVE UNIT

(71) Applicant: Forza X1, Inc, Fort Pierce, FL (US)

(72) Inventor: Daniel Norton, Fort Pierce, FL (US)

( * ) Notice: Subject to any disclaimer, the term of this patent is extended or adjusted under 35 U.S.C. 154(b) by 498 days.

(21) Appl. No.: 17/698,212

(22) Filed: Mar. 18, 2022

(65) Prior Publication Data

US 2022/0297812 A1 Sep. 22, 2022

Related U.S. Application Data

(60) Provisional application No. 63/293,420, filed on Dec. 23, 2021, provisional application No. 63/207,748, filed on Mar. 18, 2021.

(51) Int. Cl.

| | |
|---|---|
| ***B63H 20/32*** | (2006.01) |
| ***B63H 20/28*** | (2006.01) |
| ***B63H 23/06*** | (2006.01) |
| ***B63H 23/34*** | (2006.01) |
| ***B63H 25/02*** | (2006.01) |

(52) U.S. Cl.

CPC ..... *B63H 20/32* (2013.01); *B63H 20/285* (2013.01); *B63H 23/06* (2013.01); *B63H 23/34* (2013.01); *B63H 25/02* (2013.01)

(58) Field of Classification Search

None

See application file for complete search history.

(56) References Cited

U.S. PATENT DOCUMENTS

| | | | | | |
|---|---|---|---|---|---|
| 1,091,645 | A * | 3/1914 | Fisher | ..... | B63H 20/10 248/642 |
| 3,150,631 | A * | 9/1964 | Russell | ..... | B63H 20/20 440/71 |

FOREIGN PATENT DOCUMENTS

| | | | | | |
|---|---|---|---|---|---|
| EP | 411212 | A * | 2/1991 | ..... | B63H 25/34 |
| GB | 411212 | A | 6/1934 | | |
| JP | 2628870 | B2 * | 7/1997 | ..... | B63H 25/42 |
| JP | 2013252736 | A * | 12/2013 | ..... | B63H 25/42 |

* cited by examiner

*Primary Examiner* — S. Joseph Morano
*Assistant Examiner* — Jovon E Hayes
(74) *Attorney, Agent, or Firm* — Lambert Shortell & Connaughton; David J. Connaughton, Jr.; Justin P. Tinger

(57) ABSTRACT

An improved outboard and steering control system that includes a removable lower drive unit with the ability to rotate 360 degrees or more. The embodiments shown herein are also design for electric outboard marine motors with cooling systems connected between the lower drive unit and the upper housing unit. This system allows the ability to configure an upper drive unit with multiple different variations of a lower drive unit and improve the ability to maneuver vessels with the increased 360-degree directional range.

20 Claims, 15 Drawing Sheets

OUTBOARD MOTOR STEERING AND CONTROL SYSTEM AND METHODS FOR REMOVABLE LOWER DRIVE UNIT

CROSS-REFERENCED TO RELATED APPLICATIONS

This application claims the benefit of U.S. Provisional Patent Application No. 63/207,748 filed on Mar. 18, 2021 and U.S. Provisional Patent Application No. 63/293,420 filed on Dec. 23, 2021 which are herein incorporated by reference in their entirety.

FIELD OF THE INVENTION

The present invention relates to improved steering and control for outboard marine motors including electric-powered outboard motors. Also, contemplated herein is a system and method to facilitate removing and/or replacing a lower drive unit with a common upper motor housing unit.

BACKGROUND OF THE INVENTION

Currently, the boating market is dominated by combustion-driven engines. Each engine has a unique shape and power output profile. Although certain combustion motors are used across several platforms, the ease of swapping out components is not always straightforward. It is known in the industry that changing a propeller can alter the performance of a boat. The present invention relates to enabling producing a common motor or upper outboard housing unit that can be outfitted with a removable lower drive unit, which can be configured to improve steering and performance of the current outboard motor systems.

Other advantages will become apparent through reading the remaining description, drawings and claims provided herewith.

SUMMARY OF THE INVENTION

In one embodiment, an outboard motor and drive system comprises: 1) an upper housing unit configured to house a motor, the upper housing unit including: an upper housing, a slewing assembly, an upper drive shaft, and an upper lock ring; 2) a lower drive unit configured to rotate up to 360-degrees or more with respect to the upper housing unit, the lower drive unit including: a lower housing, a lower drive shaft, a lower lock ring, and a propulsion system; and 3) a locking collet configured to secure the upper lock ring about the lower lock ring.

The slewing assembly can be comprised of a housing, slewing bearing and a driving mechanism that interfaces with the slewing bearing.

The slewing assembly can further include a position encoder to determine the direction of the lower unit and ultimately the direction the propulsion is directed.

The driving mechanism of the slewing bearing assembly can include either a pinion gear or a belt that is connected to a steering motor.

The lower drive unit further can include a lower shaft that extends above the lower housing, wherein the lower drive shaft is positioned within a portion of the lower shaft.

The lower drive unit can further include a lower cooling intake configured to draw in water, wherein the lower cooling intake is in fluid communication with a lower cooling channel that is partially formed in a sidewall of the lower shaft. The lower cooling channel leads to an egress aperture formed in an upper portion of the lower shaft.

The lower shaft can further include an upper seal positioned above the egress aperture and a lower seal positioned below the egress aperture, wherein the upper and lower seals form a circular channel. This channel can be further bound by a sidewall of an upper shaft of the upper housing unit when the lower drive unit is inserted in the upper housing unit.

The upper shaft can have an ingress aperture formed in the sidewall thereof, allowing fluid communication with the circular channel, which is in fluid communication with the lower cooling channel.

The upper housing unit can further include a pump 132, a heat exchange system, a plurality of external water cooling tubes and an upper housing egress aperture that forms an external water fluid circuit, which draws water into the cooling intake, up through the lower cooling channel, through the circular channel, through the fluidly connect the pump and cooling exchange system and out the upper housing egress aperture.

The upper housing unit can further include one or more internal closed cooling circuits that are also connected to the cooling exchange system and configured to transfer heat away from the motor and other components that produce heat.

The locking collet can have a groove formed on an internal portion or surface of the collet, which corresponds in shape to an outer periphery portion of the upper and lower locking rings when joined together. In particular the upper and lower locking rings may have flange portion disposed about their respective periphery, which forms a particular shape for which the internal portion of the collet can be formed to complement. In one variation, the two locking rings form a triangular peak as viewed from the cross-section, for which the locking collet has a complementing V-shaped section to receive the two locking rings.

The lower locking ring can further include alignment protrusions extending upward that are configured to align with alignment cavities formed in the upper locking ring. These can be also be used to ensure the lower drive unit rotates at the same rate as the upper locking ring and slewing bearing assembly.

The propulsion system of the lower drive unit can include a propeller or a water jet with impeller that forms part of drive system.

The upper housing unit can further include an electric motor and electronic circuitry drawing power from batteries disposed outside of the upper housing unit.

The upper drive shaft can include a coupler and the lower drive shaft can include a coupler, wherein the respective upper drive shafter and lower drive shaft couplers are configured to be removably connected to each other.

The locking collet further can include a pivot pin about which two portions of the collect can pivot, and a locking bolt or locking clamp. When locked the locking collect is configured to maintain a rigid mechanical connection between the upper and lower lock rings.

In another embodiment an outboard motor and drive system comprises: 1) an upper housing unit configured to house a motor, the upper housing unit including: an upper housing, an electric-powered motor a slewing assembly having a slewing housing where a slewing bearing and a driving mechanism are disposed therein, an upper drive shaft, and an upper lock ring having an alignment cavity; 2) a lower drive unit configured to rotate 360-degrees with respect to the upper housing unit, the lower drive unit including: a lower housing, a lower drive shaft, a lower lock ring having an alignment protrusion, and a propulsion system driven by the lower drive shaft; and 3) a locking collet configured to secure the upper lock ring about the lower lock ring.

In yet another embodiment, an outboard motor and drive system comprises: 1) an upper housing unit configured to house a motor, the upper housing unit including: an upper housing, a slewing assembly, an upper drive shaft, and an upper lock ring; 2) a lower drive unit configured to rotate 360-degrees with respect to the upper housing unit, the lower drive unit including: a lower housing, a lower drive shaft, a lower lock ring, a propulsion system; 3) a locking collet configured to secure the upper lock ring about the lower lock ring; and 4) a cooling system comprising a pump and heat exchanger both disposed in the upper housing unit, cooling intake disposed on the lower drive unit that is in fluid communication with a lower cooling channel that is fluid communication with a circular channel that is formed when inserting the lower drive unit into the upper housing unit.

In yet another embodiment, an outboard motor and drive system can be configured to rotate 360 degrees or more without having a removable lower drive unit, the system comprising: an upper housing unit configured to house a motor, the upper housing unit including: an upper housing, a slewing assembly, and an upper drive shaft; a lower drive unit configured to up to 360-degrees or more with respect to the upper housing unit, the lower drive unit including: a lower housing, a lower drive shaft, a cooling intake, and a propulsion system; and a cooling system having a pump and heat exchanger located in the upper housing unit, the cooling system configured to draw water in from the cooling intake using the pump, run the water through the slewing assembly and into the heat exchanger.

This embodiment can also include a water outlet or egress disposed on the upper housing where water exits the cooling system that is drawn in from the cooling intake.

The slewing assembly can further include a slewing housing, slewing bearing and a pinion gear or a drive belt instead of a pinion gear.

The system can also include a driving actuator or steering motor, configured to cause the slewing bearing to rotate, thus causing the lower drive unit to rotate. This driving actuator can be a hydraulic motor that is driven by an electric pump.

Other advantages will become apparent through reading the remaining description, drawings and claims provided herewith.

BRIEF DESCRIPTION OF THE DRAWINGS

The forgoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIGS. 3A-E illustrate various exploded views of the upper housing unit, lower drive unit and the locking collet;

DETAILED DESCRIPTION OF THE INVENTION

As noted above, one of the purposes of the improved outboard motor and steering system and methods provided herein are to provide the ability to have easily removed lower drive units that can be interchangeable, as well as improved upon the flexibility of steering in outboard motors to 360 degrees of rotation, which to the applicant's knowledge has never been achieved with an outboard motor system.

Additionally, designing an outboard motor system using an electric motor with a cooling system configured design to manage the heat transfer needs associated with an electric-powered motor and the accompanying electronics required to control the system and manage power from batteries. These and other advantages will become apparent through the rest of this description.

Figure 1B:
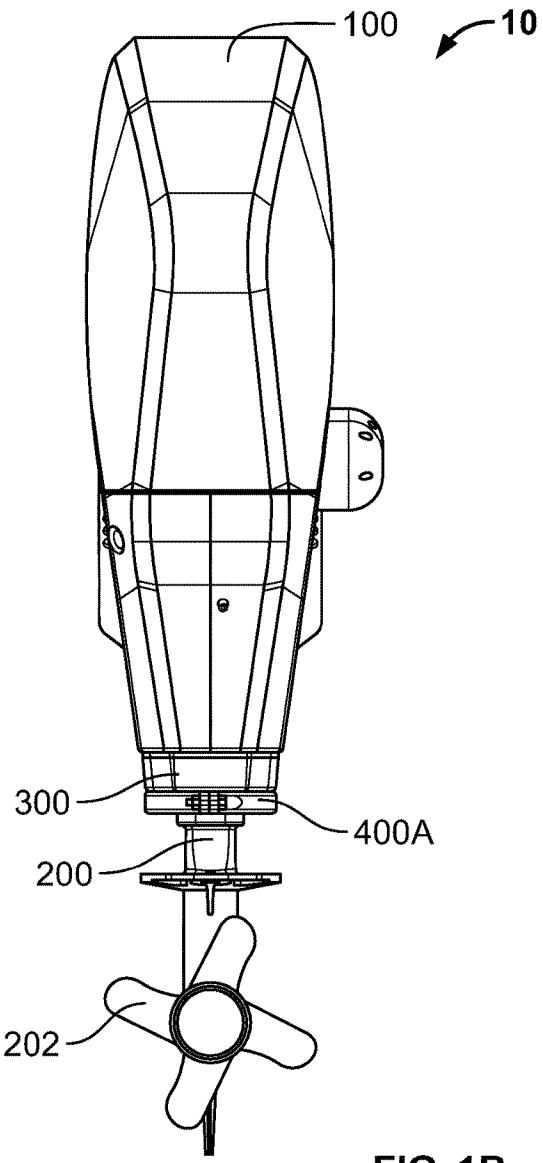
FIGS. 1A-1D illustrate various views of an embodiment of an outboard motor system with removable lower drive unit.
Figure 1A:
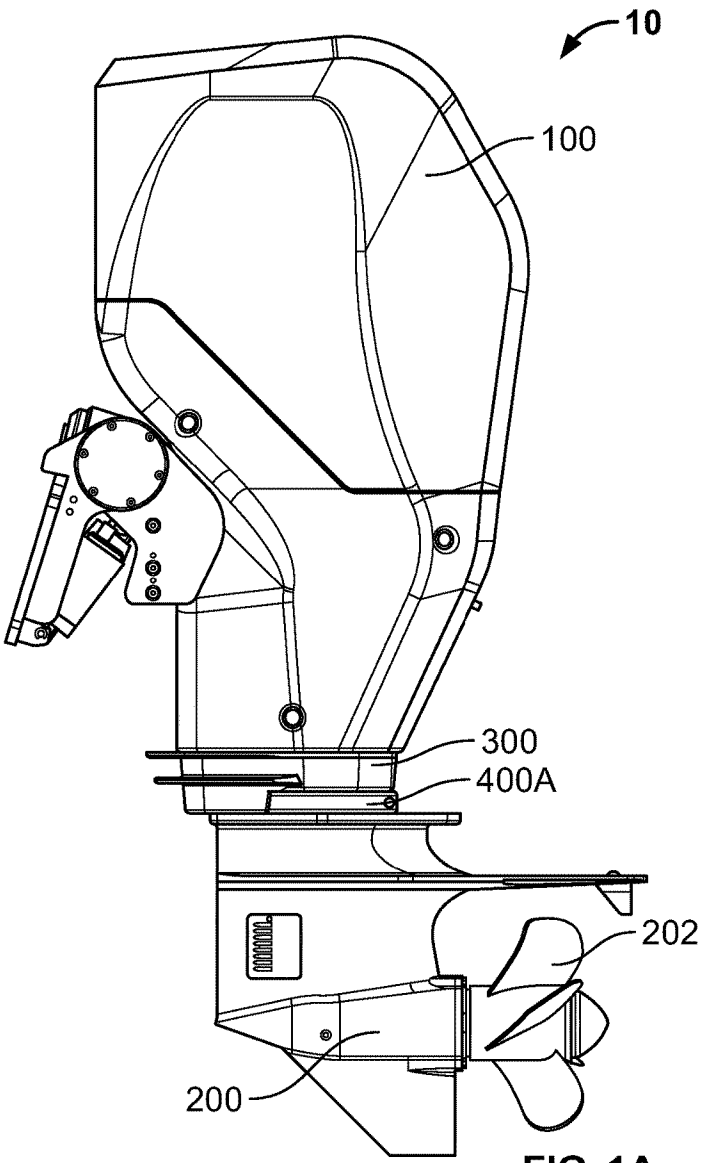
Figure 1D:
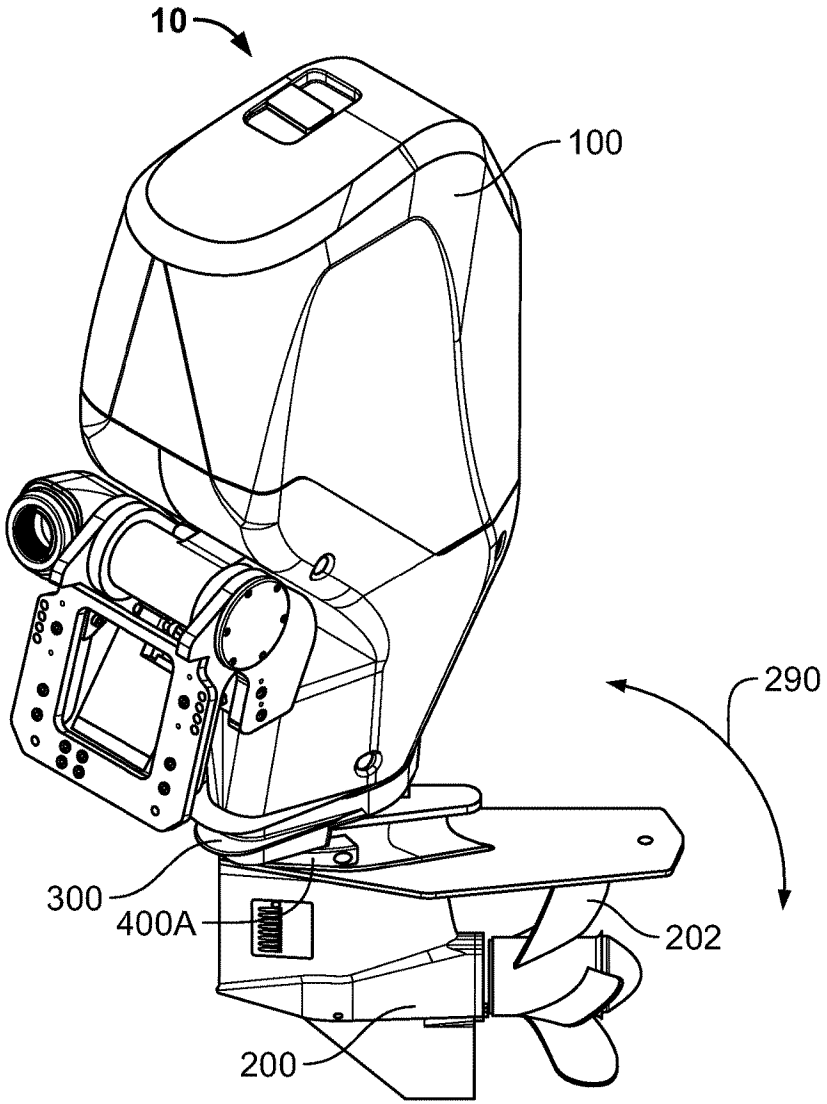
Figure 1C:
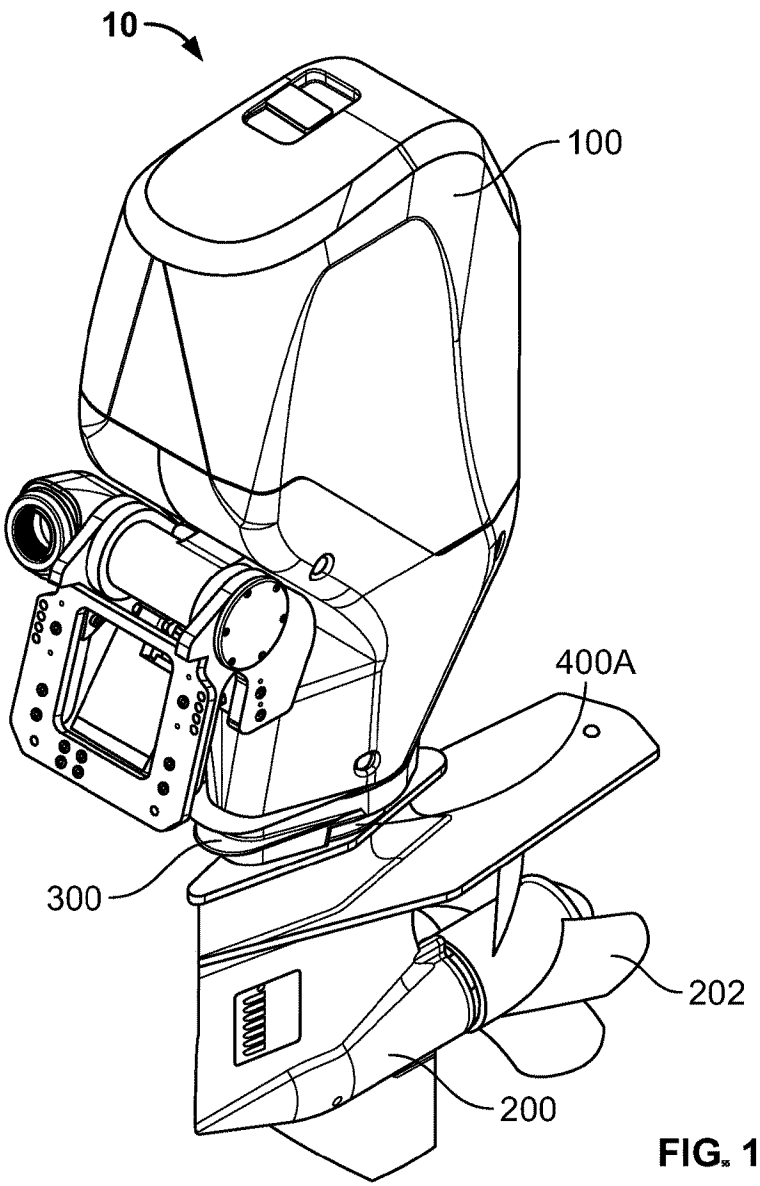

FIGS. 1A-D illustrate various views of an embodiment of an outboard motor and steering system 10 that includes an upper housing 100 and a removable lower drive unit 200. FIG. 1A is side view of 10, FIG. 1B is rear view and FIGS. 1C-D are perspective views illustrating the lower drive unit 200 pivoting about the upper housing unit 100. One of the advantages of this system 10 is that the lower drive unit 100 can rotate 290 in a full 360 degree about the upper housing unit. This eliminates the need to reverse the propeller direction and allows the user more controlling capability when navigating a boat having this system 10 attached thereto.

Also shown in these FIGS. 1A-D are one embodiment of the slewing assembly 300, which is used to rotate the lower drive unit 200 and one embodiment of the locking collet 400A, which is used to secure the lower drive unit 200 to the upper housing unit 100. Additionally, a propeller 202 is shown on the lower drive unit.

Figure 2A:
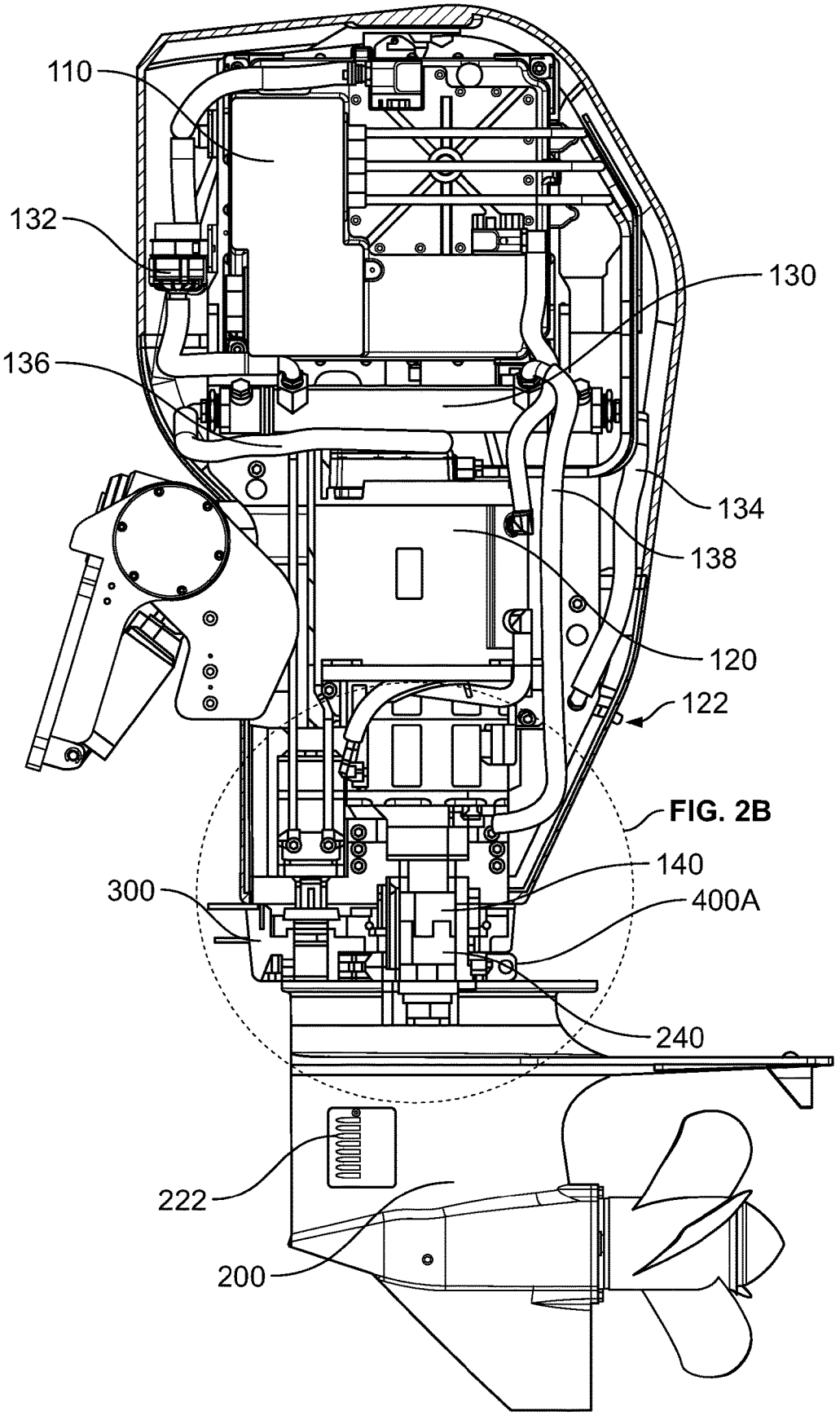
FIGS. 2A-D illustrate various views including partial cross-sectional views showing the internal components of the outboard motor system of FIGS. 1A-D.

FIGS. 2A-D, have been provided to illustrate various views including partial cross-sectional views showing the internal components of the outboard motor and steering system 10 of FIGS. 1A-D. Referring to FIG. 2A a partial cutaway of the housing of the upper housing unit reveals the various components of the system 10. The motor 120, as shown is an electrically powered motor and is controlled by controller 110, which takes input from a user steering system (not shown) as well as power from batteries (not shown). Although this system is shown using an electric motor, the principles could apply to an outboard motor that uses a combustion motor. Some advantages of using electric motors are a reduction in size or increased power for the same amount of space, given there is sufficient electric power available. Most of the embodiments contemplated herein have the batteries being stored on the boat and not in the upper housing unit. However, it is possible to store some batteries within the upper housing unit 100.

In the upper portion of FIG. 2A, one can also see the heat exchanger system 130, where sea-water or external water is drawn into the exchanger 130 starting from the lower drive cooling intake 222. External cooling tubes 134 and 136 carry the external water or sea-water in the upper housing portion into and away from the exchanger 130. For example, external cooling tube 134 carries external water away from the heat exchanger 130 and out through the upper housing egress 122, which is the external cooling channel outlet of the system. Additional detail of how the external cooling water navigates from the cooling intake 222 and through the lower drive unit into the upper housing unit is described in more detail below. The heat exchanger can use the external sea-water to cool closed circuit cooling loops. For example, closed circuit tube 138 can carry a fluid, such as glycol, away from the heat exchanger system 130, after the fluid has been cooled, to the gear reducer (not labeled). Other closed-circuit tubes can take the cooling fluid to other parts of the system, such as the motor and electronic components.

Figure 2B:
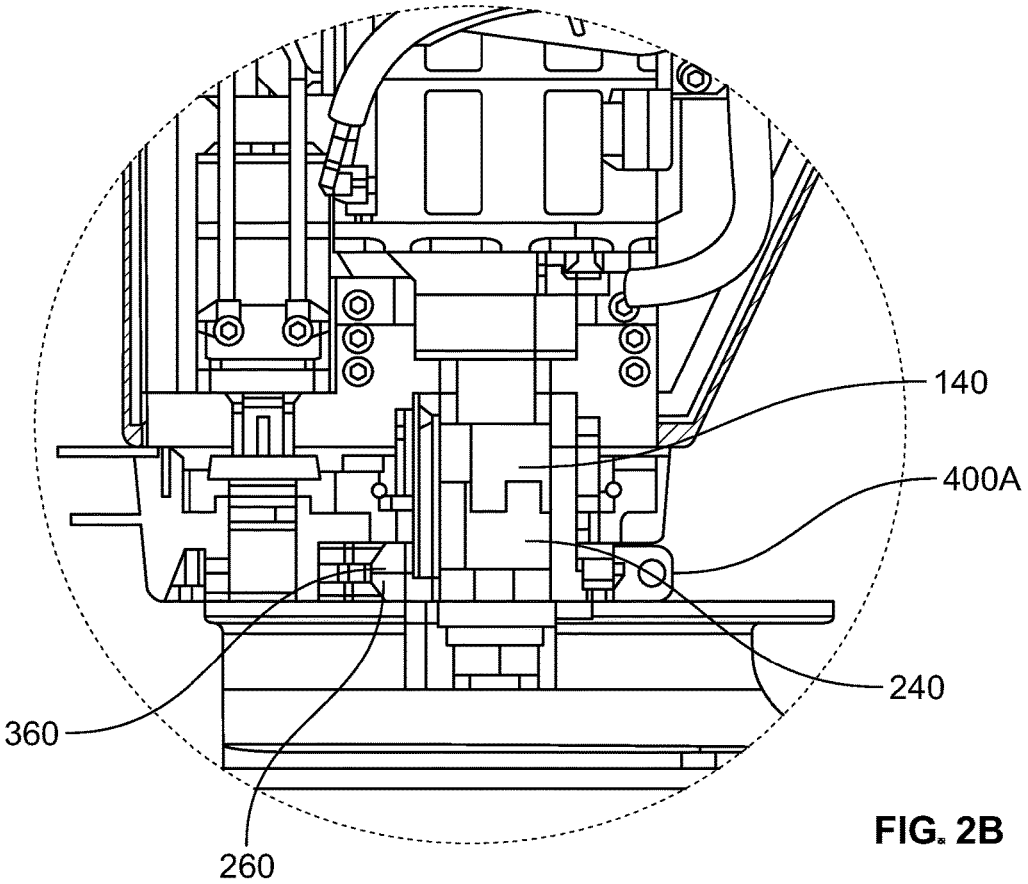

Referring to FIG. 2B, which is zoomed-in-section of FIG. 2A, are additional components of the upper housing unit and lower drive unit the interface with each other. For example, the upper motor shaft coupler 140 interfaces with the lower drive shaft coupler 240. Thus, when the motor shaft 142 is rotated by the motor, it drives the coupler 140 to drive the coupler 240, which in turn rotates the lower drive shaft 242, which then drives the propulsion system of the lower drive unit. Also shown in this same figure, is the upper locking ring 360 and the lower locking ring 260.

Figure 2C:
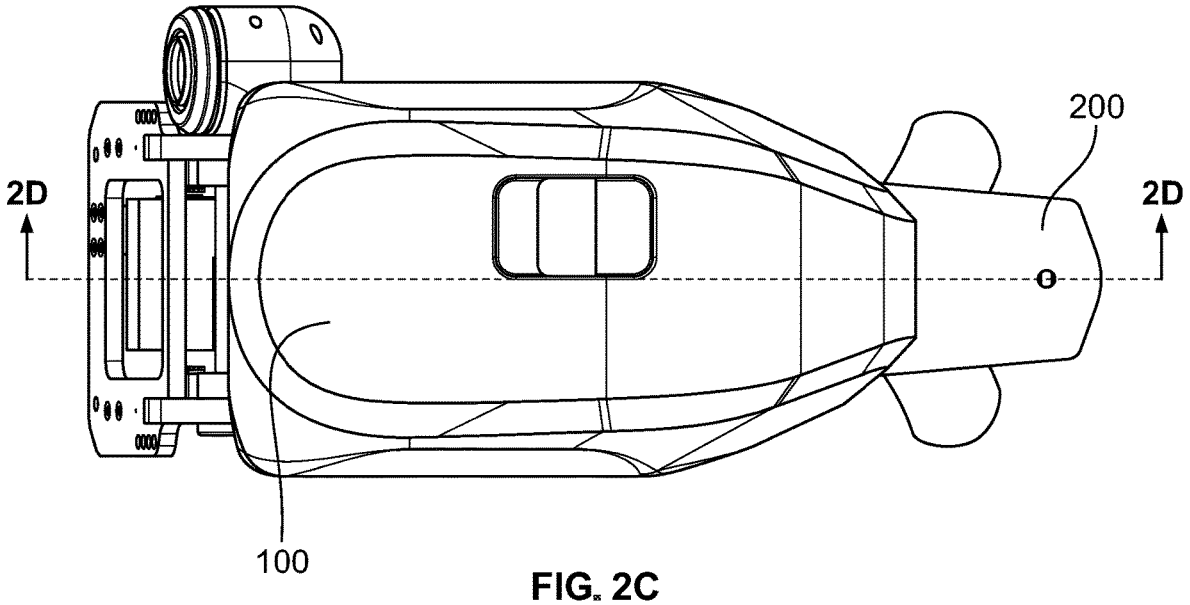
Figure 2D:
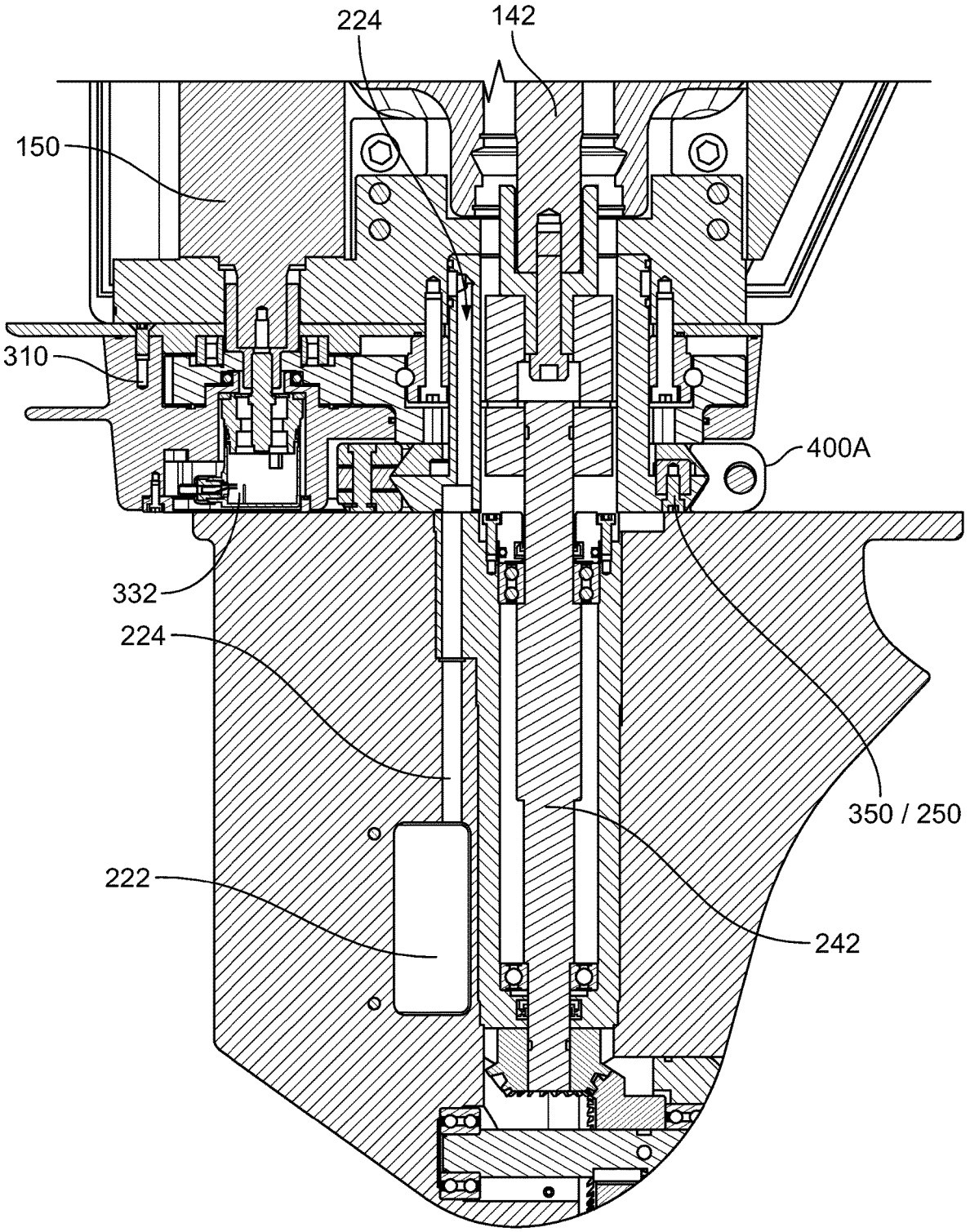

FIG. 2C is a top view of system 10, showing where the plane where a partial cross-sectional of the system is shown in greater detail in FIG. 2D. A cross-sectional view of the steering actuator or drive motor 150 is shown, which is used to drive the slewing bearing system 400A (as shown) or alternative embodiment 400B. The cavity of the cooling intake 222 is shown, which in fluid communication with the lower cooling channel 224. Additional detail on the external cooling circuit will be shown in FIGS. 7A-B.

Figure 3A:
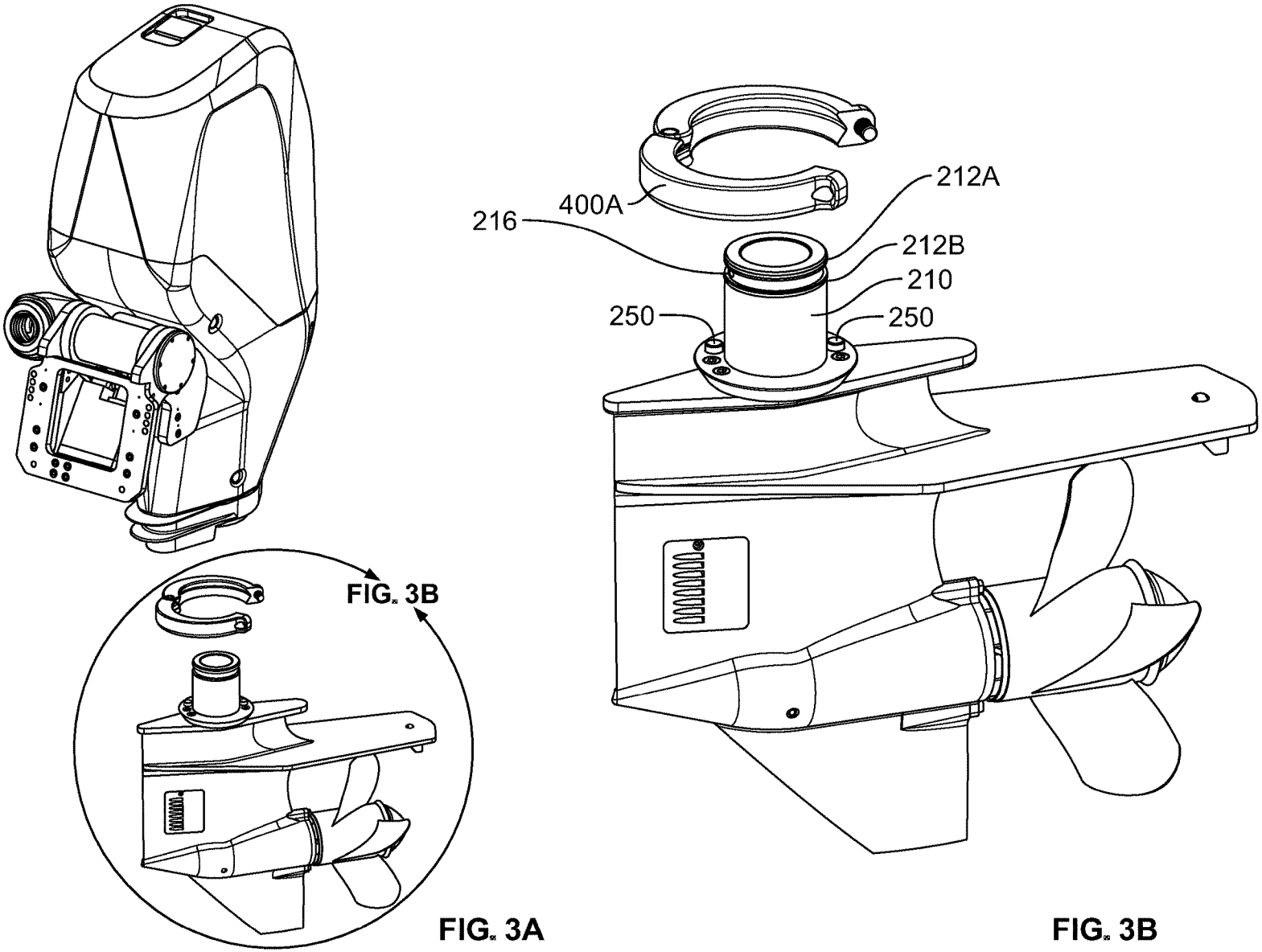
Figure 3C:
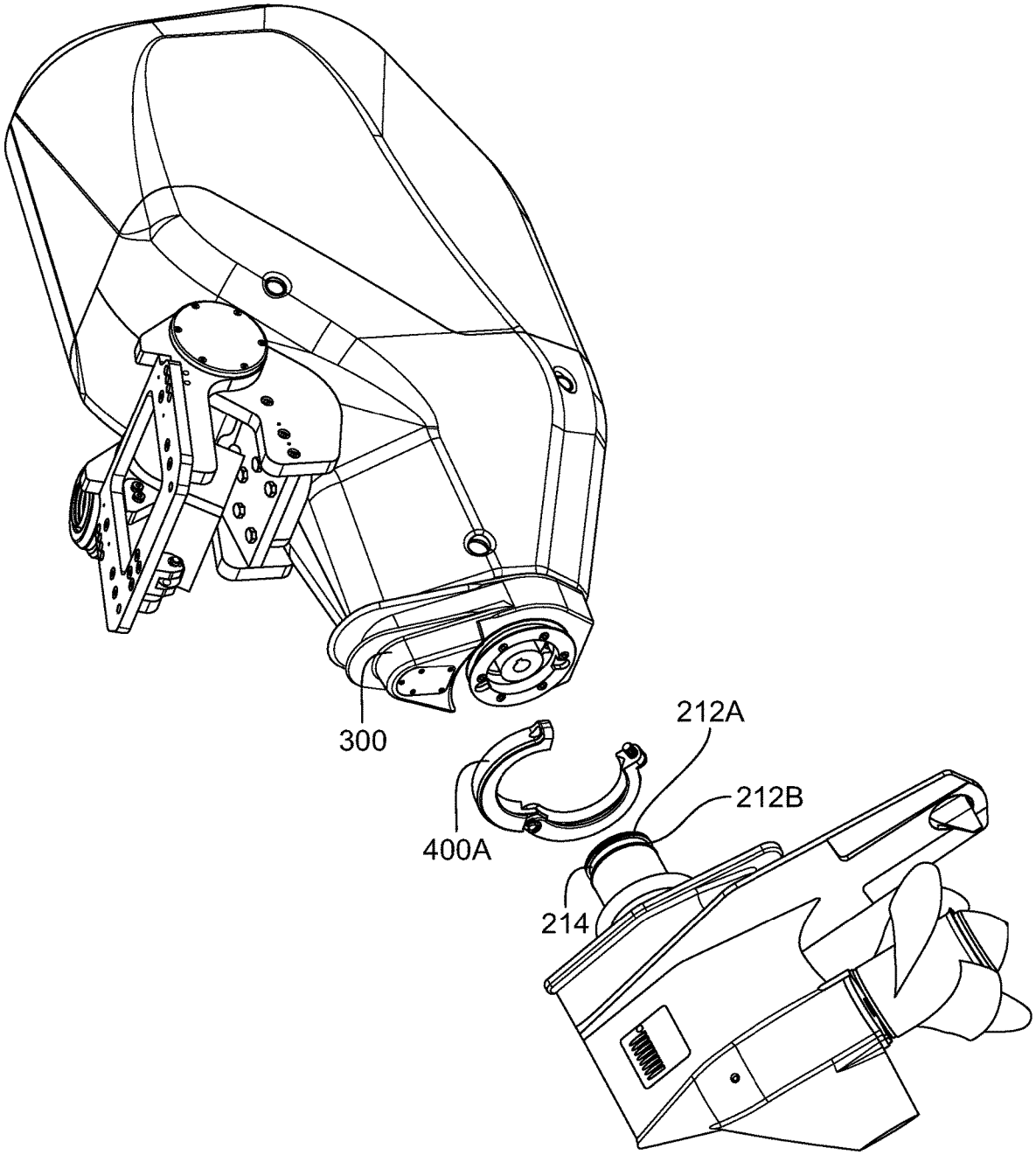
Figure 3E:
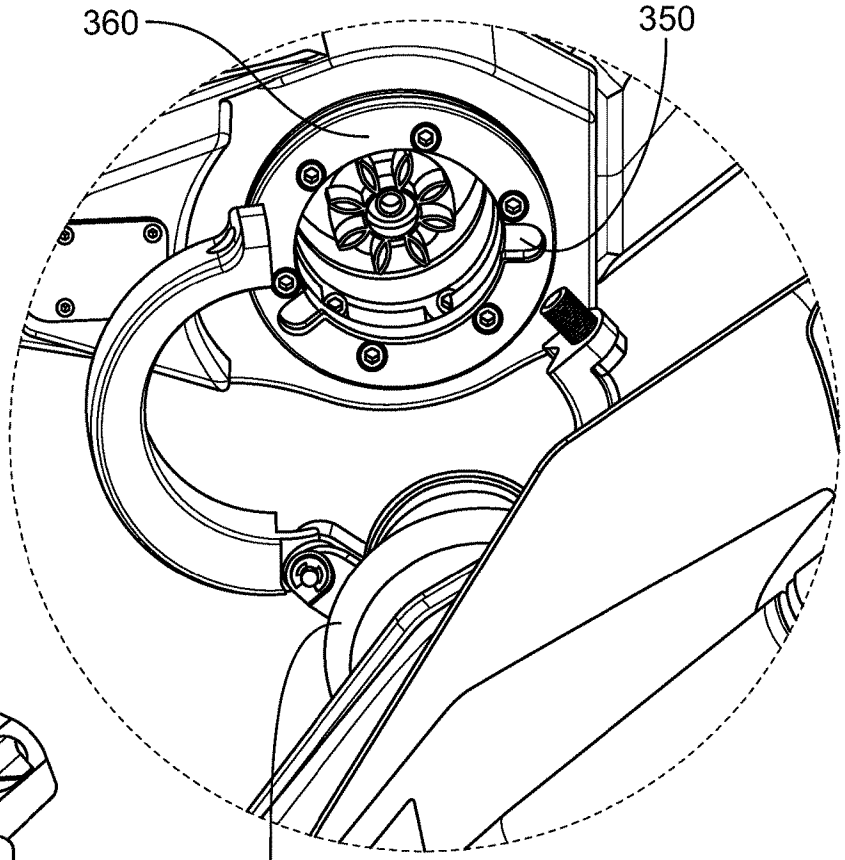
Figure 3D:
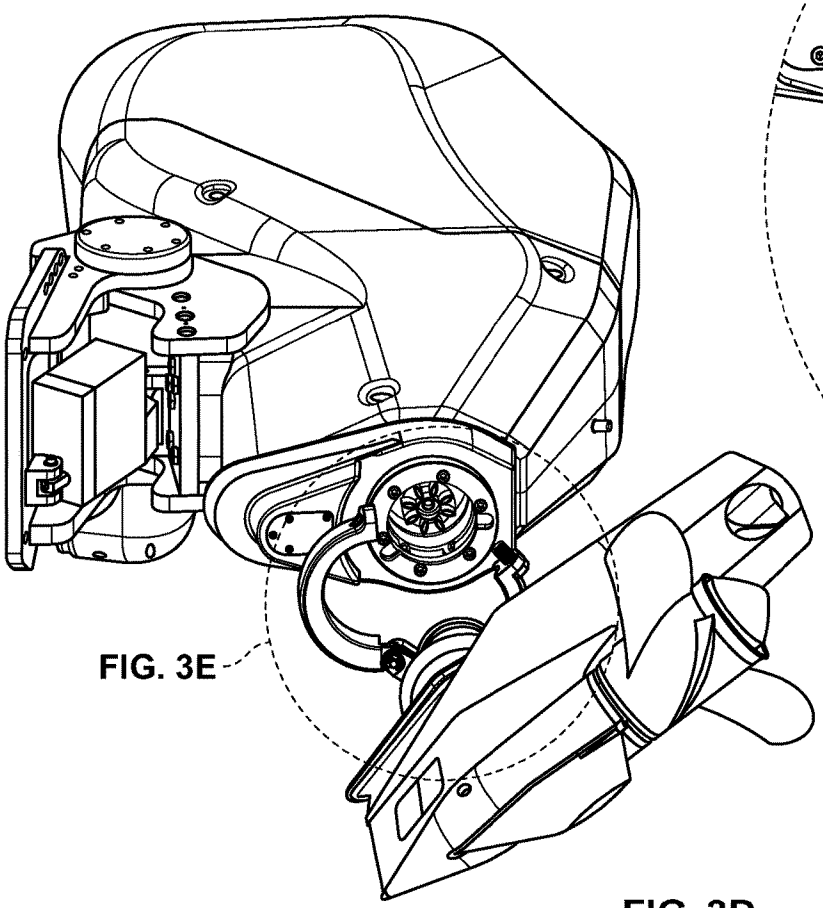
Figure 4A:
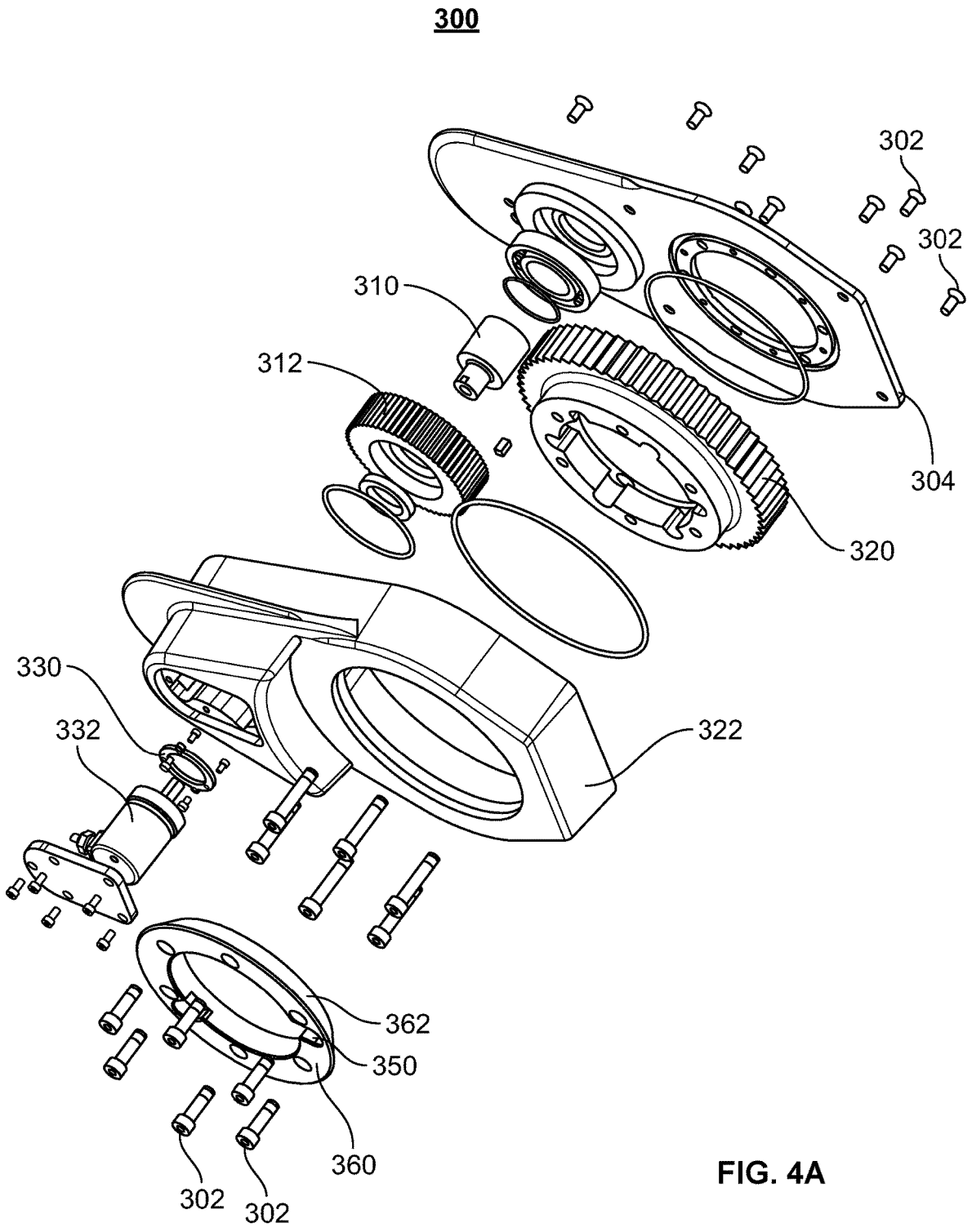
FIGS. 4A-B illustrate various embodiments of a slewing bearing assembly.

FIGS. 3A-E illustrate various exploded views of the upper housing unit, lower drive unit and the locking collet. In FIG. 3A, is perspective view of the upper housing unit, lower drive unit and collet. FIG. 3B is a zoomed in view of the collet 400A and the upper portion of the lower drive unit, which includes the lower shaft 210, that houses a portion of the lower drive shaft 242, upper and lower seals 212A and 212B that form a circular channel 214 between them, which has a lower shaft egress 216 or cooling intake aperture formed in a sidewall of the lower shaft 210 between the upper and lower seals 212A-B. Also shown, are alignment pins 250 extending from the lower locking ring 260, which pins are configured to interface with alignment cavities 350 of the upper locking ring 360. This alignment of 250/350 can be seen in FIG. 2D. FIG. 3C illustrates a lower exploded perspective view of the upper housing unit, lower drive unit and locking collet, where it is easier to see the slewing bearing assembly 300. FIG. 3D and zoomed in view FIG. 3E show additional views, of the locking ring 360 and its alignment cavities 350. The alignment cavities 350 are not space symmetrically from each other, so as to intentionally force only one way of mating the upper and lower locking rings together. Also shown in FIG. 3E is the flange portion 262 of the lower locking ring 260. FIG. 4A shows the flange portion 362 of the upper locking ring 360.

Figure 3F:
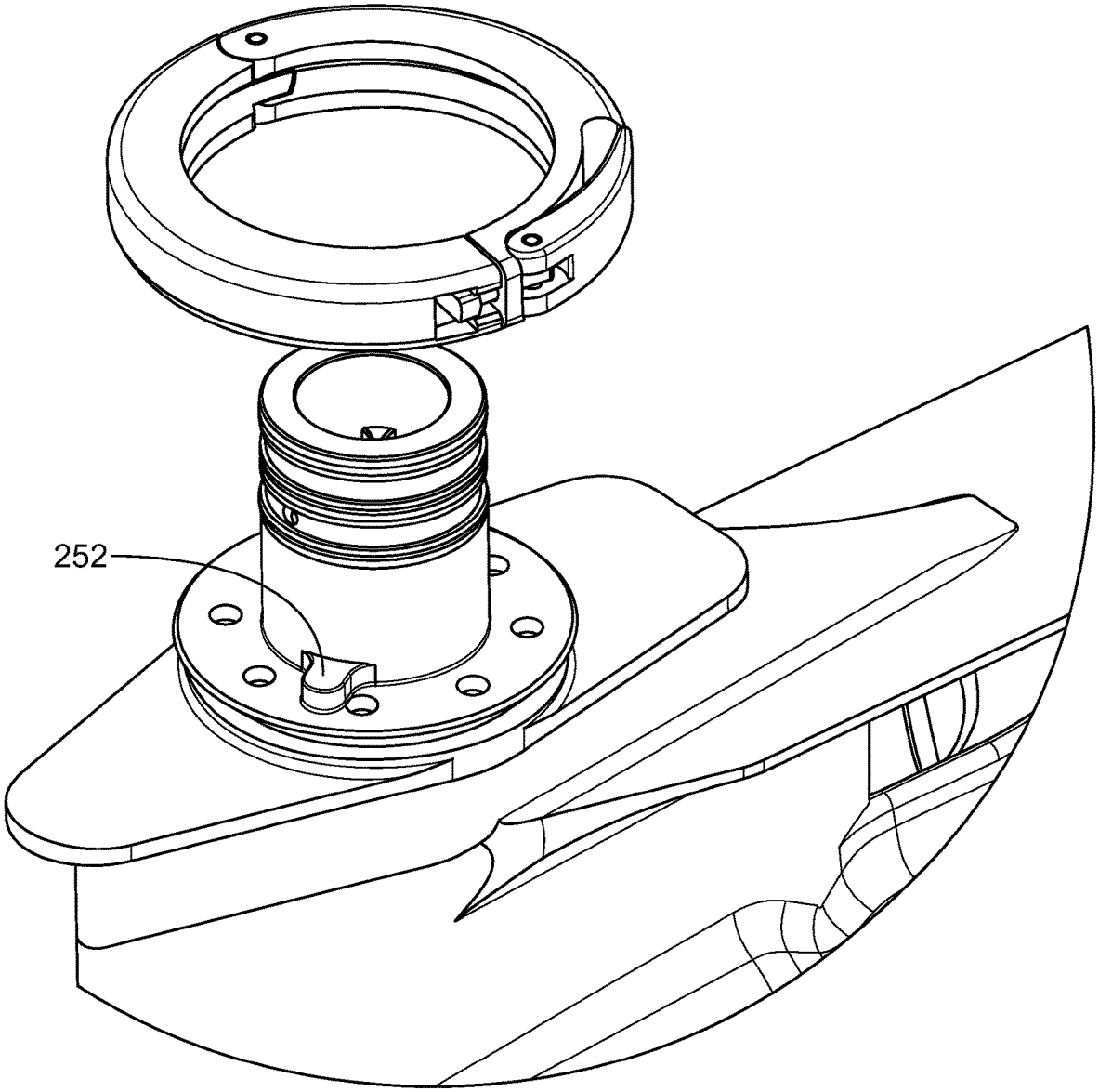
FIG. 3F illustrates an alternative embodiment of a locking collet and upper portion of the lower drive unit.

FIG. 3F illustrates an alternative embodiment of a locking collet and upper portion of the lower drive unit, which utilizes orientation teeth 252 as opposed to alignment pins 250 to interface with the alignment cavities 350. This alternative embodiment is meant to convey that there multiple ways of creating alignment features that interface with alignment cavities to match up the upper and lower locking rings. It should also be understood that the cavities and alignment features can be reversed, meaning the lower locking ring could have alignment cavities and the upper ring could have alignment features. Yet again, each locking ring could have one or of each cavity or feature, with one purpose being for alignment. Another purpose, is the alignment features can be used to transfer a rotational force to the lower drive unit, that causes the lower drive unit to rotate. This rotational force is generated by the slewing bearing assembly.

Figure 4B:
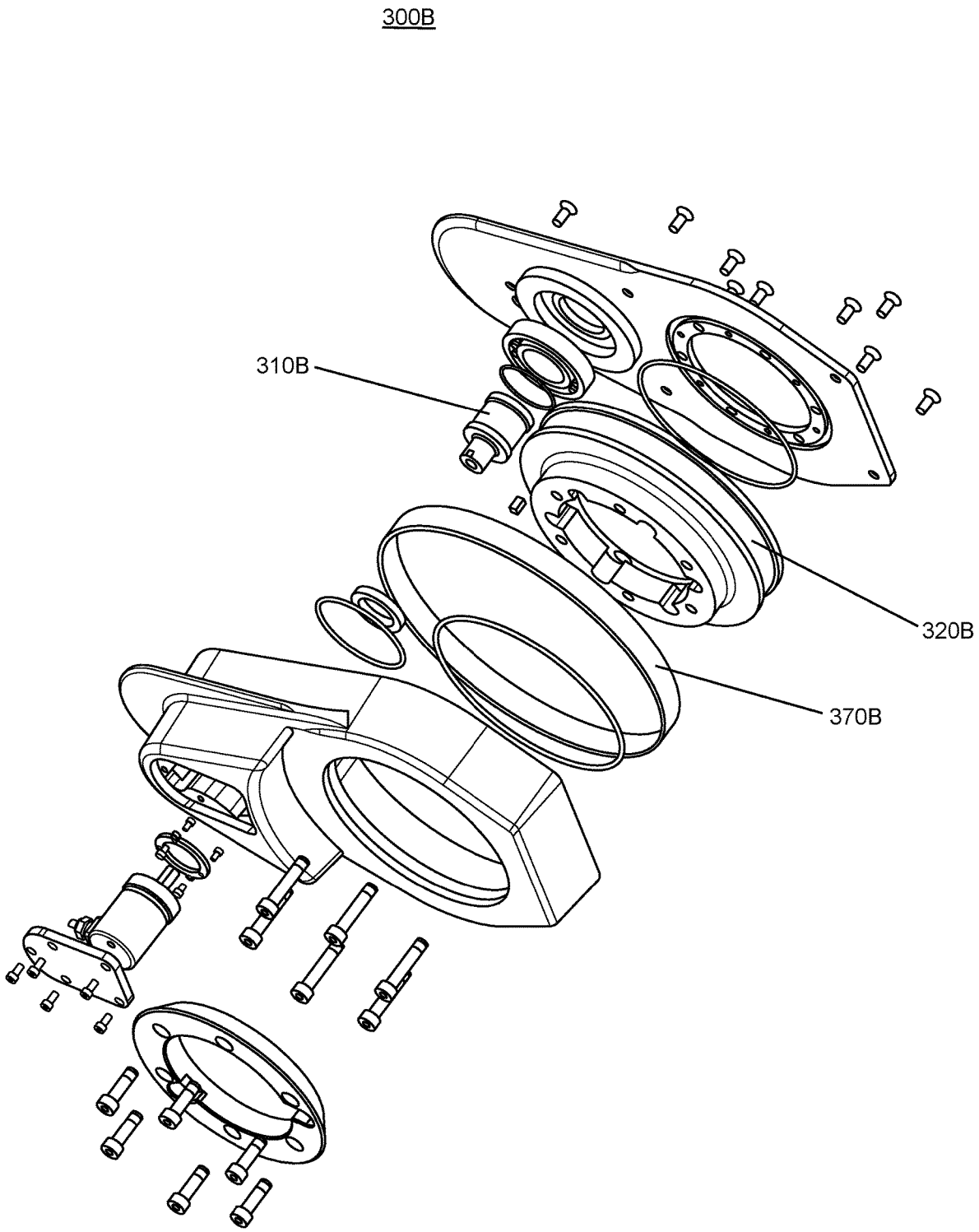

FIGS. 4A-B illustrate various embodiments of a slewing bearing assemblies. In FIG. 4A, slewing bearing assembly 300 is comprised of a slewing housing 322, which houses the slewing bearing 320 that is driven by pinion gear 312, which is connected to pinion shaft 310 that is rotated by the steering actuator or drive motor 150 noted above. This steering actuator could be a hydraulic motor that is driven by an electric pump. The drive motor, could also be an electric motor. Various mounting screws 302 are used to assemble the mounting plate 304 to the slewing housing, as well as the upper locking ring 360 to the slewing assembly 300. Also included in the slewing assembly 300 are an encoder ring 330 and position encoder 332, which are used to determine the position of the lower drive unit and provide location feedback.

In an alternative embodiment, slewing bearing assembly 300B, shown in FIG. 4B, includes slewing bearing 320B that is driven by a belt 370B, that is driven by a belt shaft 310B, that is driven by steering actuator 150. Again, the purpose of this alternative embodiment is to convey that a variety of driving mechanisms can be used to rotate the slewing bearing, which is used to rotate the upper locking ring and ultimately the lower locking ring and lower drive unit that is attached thereto and held in place by the locking collet.

Figure 5A:
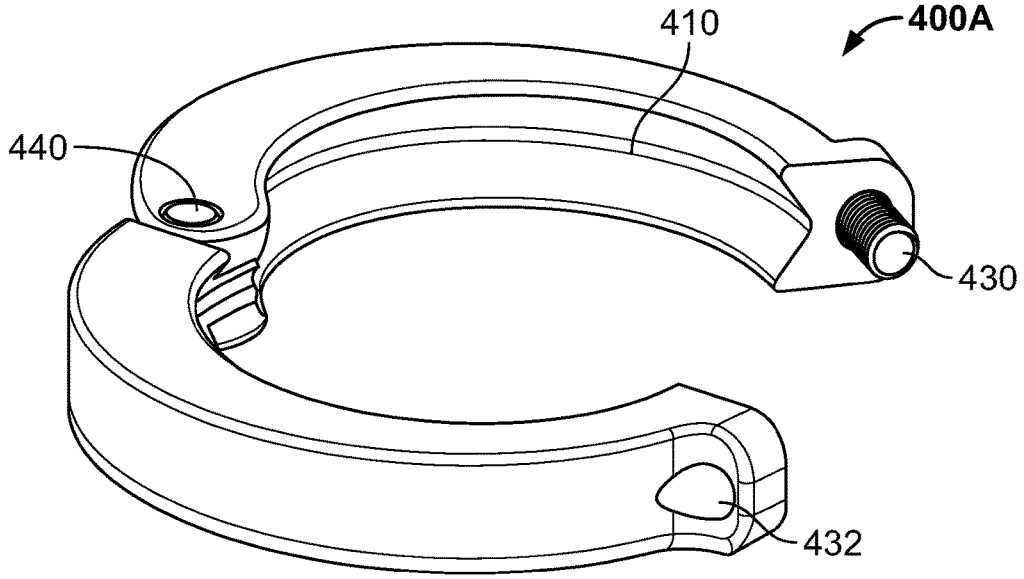
FIGS. 5A-C illustrate various embodiments of a locking collet.
Figure 5B:
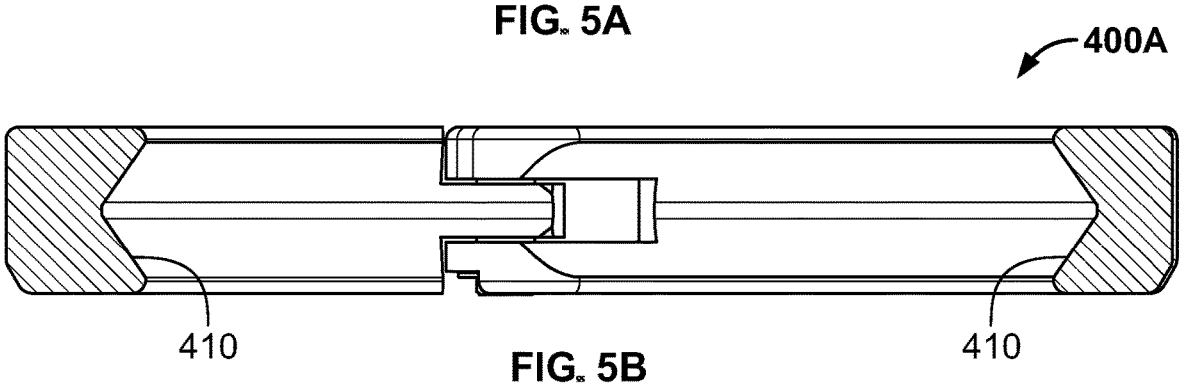
Figure 5C:
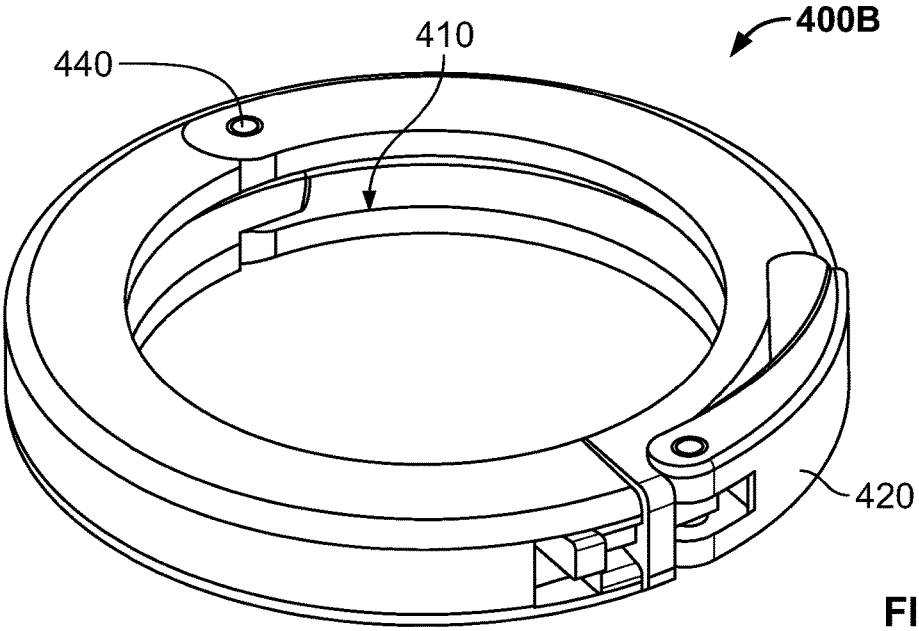

FIGS. 5A-C illustrate various embodiments of locking collets 400A and 400B that are used to secure the upper housing and lower drive unit together about the upper locking ring and lower locking rings. In embodiment 400A, a bolt 430 and mating channel 432 are used to tighten the locking collet once secured about the locking rings. The locking collet pivots about a pivot pin 440 as shown in FIG. 5A, to spread open and fit around the locking rings, where once fitted, then the bolt and mating channel can be used to tighten the ring about the locking rings. FIG. 5B illustrates a cross-sectional view of FIG. 5A, showing the internal alignment groove 410 formed on an inter portion or sidewall of the locking collet. This groove or alignment groove can be shaped to correspond or complement that shape of the outer periphery shape formed by both the upper and lower locking rings when combined. As shown, the groove has V-shape, but it can be imagined that various shapes and grooves could be used to accomplish the task. The V-shape in particular, helps force the upper and lower locking rings together. An alternative locking collet 400B is shown in FIG. 5C, however, instead of using a bolt and mating channel to lock the two arms together a locking clamp or quick-release clamp 420 is used. Again, illustrating that various locking mechanisms can be used to secure the locking collet to the upper and lower locking rings.

Figure 6A:
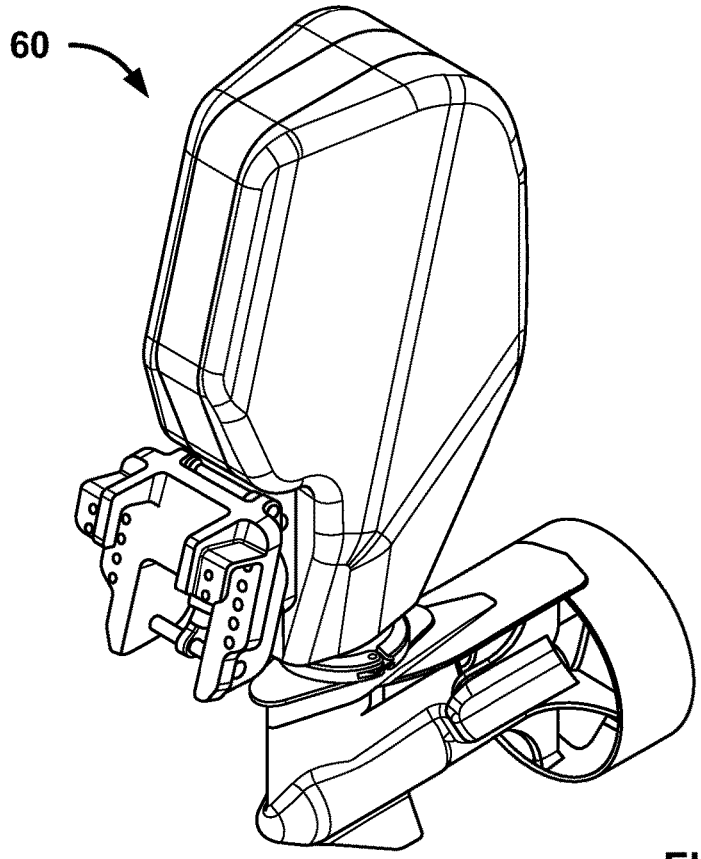
FIGS. 6A-B illustrate an alternative lower drive unit.
Figure 6B:
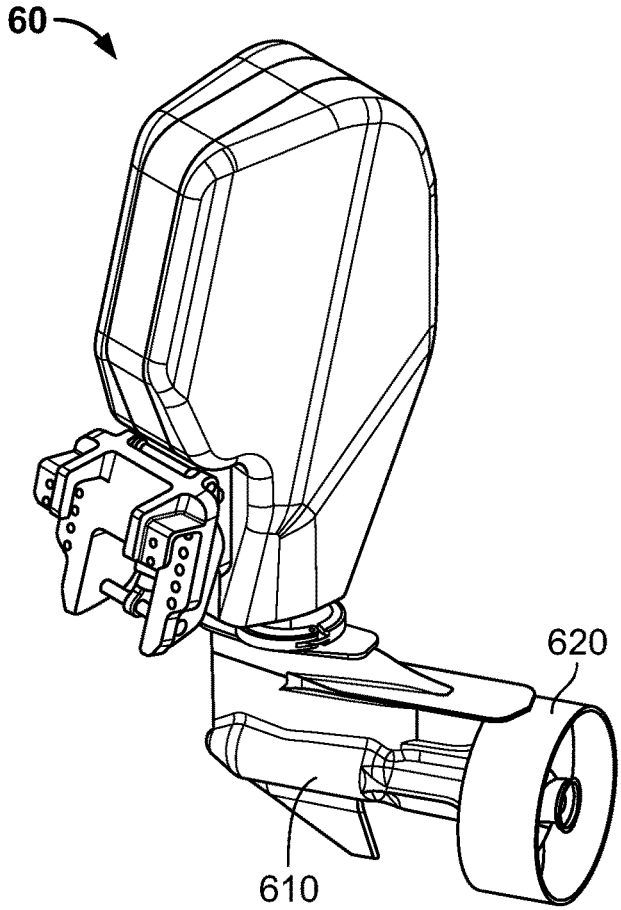

FIGS. 6A-B illustrate various views of an alternative outboard motor and steering system 60 that includes a different or alternative lower drive unit 610 having an alternative propeller and cage system 620. If it wasn't clear before, various styles of lower drive units having various propulsion systems can be interchanged with the same upper housing unit, so long as they use the same mating system and connection system as described above. These propulsion systems could include various types of propellers and impellerrs used in jet-driven systems.

Figure 7A:
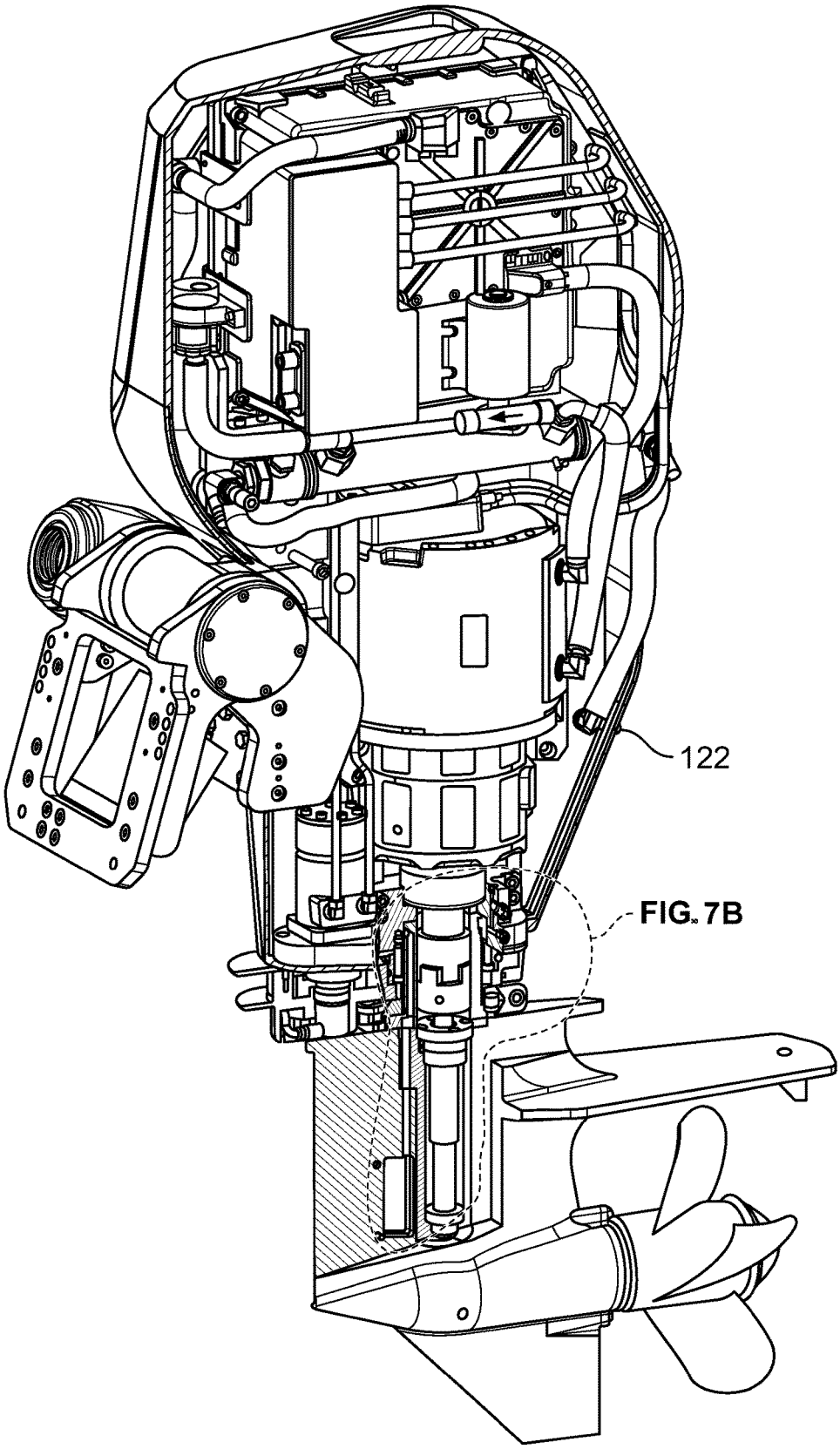
FIGS. 7A-B illustrate various views illustrating the intake cooling system of the lower drive unit leading into the upper housing unit.
Figure 7B:
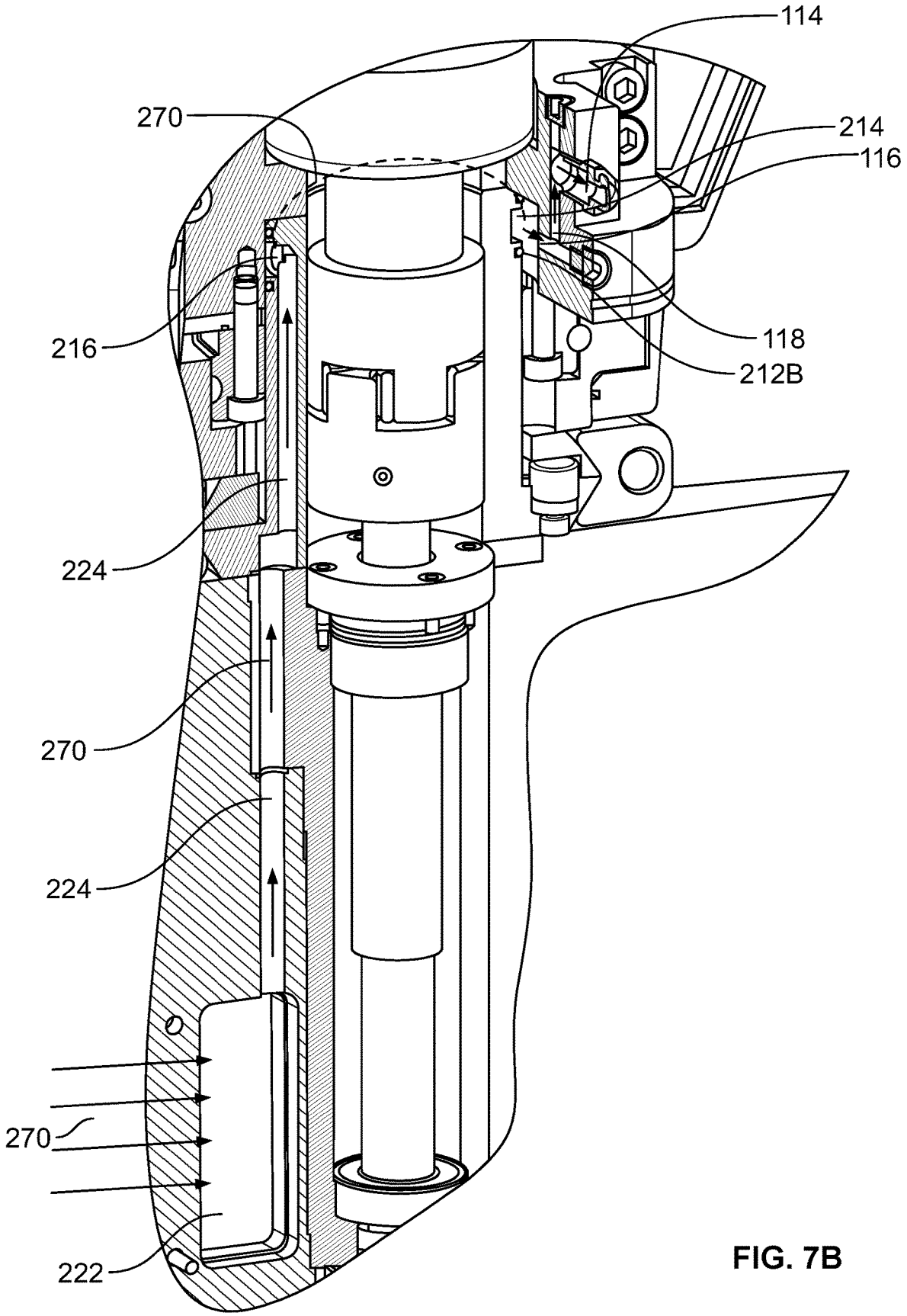

FIGS. 7A-B illustrate various views illustrating the intake cooling system of the lower drive unit 200 leading into the upper housing unit 100. Here the cooling fluid path is labeled as 270, which as noted above, begins by entering through the cooling intake 222, which leads to the lower cooling channel 224. A portion of the lower cooling channel 224 is formed in the sidewall of the lower shaft 210, which exits into the circular channel 214, by the lower shaft egress or aperture 216. Once in the circular shaft 214 the cooling fluid (sea-water or lake water most of the time) can enter into the upper housing unit via the upper shaft ingress or aperture 116, which leads into the upper cooling channel 118. The upper cooling channel 118 then connects to an upper cooling channer coupler 114 that connects to cooling tubes that lead to the heat exchanger 130. The cooling water draws heat away from heat transferred into the heat exchanger by the closed cooling circuit or circuits as there may be multiple closed-cooling circuits. These closed cooling circuits draw heat away from various components, such as gear reducers, motors and electronics, during use and transfer that heat to the exchanger, here the external cooling water or sea-water draws the heat out of the closed cooling circuit and transfers the heated external water out of the system via the cooling channel outlet or egress 122 as noted above. As most bodies of water that boats operate on are massive, it is very advantageous to take advantage of the large cooling body to control temperature in the system.

It should be noted that the circular path 214 can be bound or completely formed when the lower drive shaft is inserted into the upper housing unit, as the upper and lower seals 212A-B form the circular channel between the lower shaft and upper shaft sidewalls.

As noted in the summary section, a version could be included where the lower drive unit is not removable, and thus integrated with the upper housing unit, but there are many advantages of having a rotatable lower drive unit that can rotate up to 360 degrees or more, which effectively means the lower drive unit once approaching 360 degrees does not have to reverse course, but can keep rotating around and around multiple times, thus rotating up to and more than 360 degrees. The value of having a 360-degree rotatable lower drive unit should be apparent to those in the art. Having a lower intake that is connected to cooling channels routed through the slewing assembly, helps with the ability to full rotate, while providing a cooling system that takes advantage of the position of the lower drive unit in the water, to help cool those components in the upper housing unit that generally, when mounted to a boat, stay above water during use.

While, the principles of the invention have been described herein, it is to be understood by those skilled in the art that this description is made only by way of example and not as a limitation as to the scope of the invention. Other embodiments are contemplated within the scope of the present invention in addition to the exemplary embodiment shown and describe herein. Modifications and substitutions by one of ordinary skill in the art are considered to be within the scope of the present invention.

The invention claimed is:

1. An outboard motor and drive system comprising:

an upper housing unit configured to house a motor, the upper housing unit including:

an upper housing, a slewing assembly, an upper drive shaft, and an upper lock ring;

a lower drive unit configured to rotate 360-degrees with respect to the upper housing unit, the lower drive unit including:

a lower housing, a lower drive shaft, a lower lock ring, and a propulsion system; and a locking collet configured to secure the upper lock ring about the lower lock ring.

2. The outboard motor and drive system of claim 1, wherein the slewing assembly is comprised of a housing, slewing bearing and a driving mechanism that interfaces with the slewing bearing.

3. The outboard motor and drive system of claim 2, wherein the slewing assembly further includes a position encoder.

4. The outboard motor and drive system of claim 2, wherein the driving mechanism includes either a pinion gear or a belt and is further connected to a steering motor or driving actuator.

5. The outboard motor and drive system of claim 1, wherein the lower drive unit further includes a lower shaft that extends above the lower housing, wherein the lower drive shaft is positioned within a portion of the lower shaft.

6. The outboard motor and drive system of claim 5, wherein the lower drive unit further includes a lower cooling intake configured to draw in water, wherein the lower cooling intake is in fluid communication with a lower cooling channel that is partially formed in a sidewall of the lower shaft.

7. The outboard motor and drive system of claim 6, wherein the lower cooling channel leads to an egress aperture formed in an upper portion of the lower shaft.

8. The outboard motor and drive system of claim 7, wherein the lower shaft further includes an upper seal positioned above the egress aperture and a lower seal positioned below the egress aperture, wherein the upper and lower seals when inserted into the upper housing unit form a circular channel with a sidewall of an upper shaft of the upper housing unit.

9. The outboard motor and drive system of claim 8, wherein the upper shaft has an ingress aperture formed in the sidewall thereof, allowing fluid communication with the circular channel, which is in fluid communication with the lower cooling channel.

10. The outboard motor and drive system of claim 9, wherein the upper housing unit further includes a pump, a cooling exchange system, a plurality of external water cooling tubes and an upper housing egress aperture that forms an external water fluid circuit, which draws water into the cooling intake, up through the lower cooling channel, through the circular channel, through the fluidly connect the pump and cooling exchange system and out the upper housing egress aperture.

11. The outboard motor and drive system of claim 10, wherein the upper housing unit further includes one or more internal closed cooling circuits that are also connected to the cooling exchange system and configured to transfer heat away from the motor.

12. The outboard motor and drive system of claim 1, wherein the locking collet has a groove formed on an internal portion, and wherein the groove corresponds in shape to an outer periphery portion of the upper and lower locking rings when joined together.

13. The outboard motor and drive system of claim 1, wherein the lower locking ring further includes alignment protrusions extending upward that are configured to align with alignment cavities formed in the upper locking ring.

14. The outboard motor and drive system of claim 1, wherein the propulsion system of the lower drive unit can include a propellor or an impellor that forms part of drive system.

15. The outboard motor and drive system of claim 1, wherein the upper housing unit further includes an electric motor and electronic circuitry drawing power from batteries disposed outside of the upper housing unit.

16. The outboard motor and drive system of claim 1, wherein the upper drive shaft includes a coupler and the lower drive shaft includes a coupler, and wherein the respective upper drive shafter and lower drive shaft couplers are configured to be removably connected to each other.

17. The outboard motor and drive system of claim 1, wherein the locking collet further includes a pivot pin about which two portions of the collect can pivot, and a locking bolt or locking clamp.

18. The outboard motor and drive system of claim 17, wherein the locking collect is configured to maintain a seal formed between the upper and lower lock rings.

19. An outboard motor and drive system comprising:

an upper housing unit configured to house a motor, the upper housing unit including:
- an upper housing,
- an electric-powered motor
- a slewing assembly having a slewing housing where a slewing bearing and a driving mechanism are disposed therein,
- an upper drive shaft, and
- an upper lock ring having an alignment cavity;

a lower drive unit configured to rotate up to 360-degrees with respect to the upper housing unit, the lower drive unit including:
- a lower housing,
- a lower drive shaft,
- a lower lock ring having an alignment protrusion, and
- a propulsion system driven by the lower drive shaft; and a locking collet configured to secure the upper lock ring about the lower lock ring.

20. An outboard motor and drive system comprising:

an upper housing unit configured to house a motor, the upper housing unit including:
- an upper housing,
- a slewing assembly,
- an upper drive shaft, and
- an upper lock ring;

a lower drive unit configured to rotate at least 360-degrees with respect to the upper housing unit, the lower drive unit including:
- a lower housing,
- a lower drive shaft,
- a lower lock ring,
- a propulsion system;

a locking collet configured to secure the upper lock ring about the lower lock ring;

and a cooling system comprising a pump and heat exchanger both disposed in the upper housing unit, cooling intake disposed on the lower drive unit that is in fluid communication with a lower cooling channel that is fluid communication with a circular channel that is formed when inserting the lower drive unit into the upper housing unit.

* * * * *